US006819093B1

(12) United States Patent
Kay

(10) Patent No.: US 6,819,093 B1
(45) Date of Patent: Nov. 16, 2004

(54) GENERATING MULTIPLE CURRENTS FROM ONE REFERENCE RESISTOR

(75) Inventor: Michael R. Kay, Summerfield, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 65 days.

(21) Appl. No.: 10/429,318

(22) Filed: May 5, 2003

(51) Int. Cl.[7] ..... G05F 3/16
(52) U.S. Cl. ..... 323/315; 323/353; 323/907
(58) Field of Search ..... 323/315, 353, 323/354, 369, 907

(56) References Cited

U.S. PATENT DOCUMENTS 5,155,429 A * 10/1992 Nakao et al. ..... 323/315

* cited by examiner

*Primary Examiner*—Jeffrey Sterrett
(74) *Attorney, Agent, or Firm*—Withrow & Terranova, PLLC

(57) ABSTRACT

The multiplication circuitry of the present invention operates to generate multiple monolithic electrical currents, all referenced to a single external resistor. A first current referenced to a first monolithic resistor, a second current referenced to a second monolithic resistor, and a third current referenced to an external resistor are used to generate an output current, which is also referenced to the external resistor. The present invention accurately generates two currents each being referenced to the single external resistor, while simultaneously minimizing the number of external connections and overall cost of producing the circuitry.

33 Claims, 5 Drawing Sheets

GENERATING MULTIPLE CURRENTS FROM ONE REFERENCE RESISTOR

FIELD OF THE INVENTION

The present invention relates to accurately controlling the current in an integrated circuit, and more specifically relates to generating multiple monolithic electrical currents, all referenced to a single accurate resistor.

BACKGROUND OF THE INVENTION

As the need to reduce current in transceiver products and other integrated circuits increases, the need to more accurately control this current also increases. Typically, a design for an integrated circuit requires two currents: a current proportional to absolute temperature (IPTAT) and a bias current, which is defined herein as a current independent of temperature (IBIAS). In general, these currents are generated by placing an accurate on-chip voltage, such as a bandgap voltage or a thermal voltage, across a monolithic resistor. A monolithic resistor, also referred to as an internal resistor, is a resistor manufactured on the same semiconductor die as the associated integrated circuit. These electrical currents IPTAT and IBIAS are then provided to a current mirror, where the currents are mirrored as many times as necessary throughout the circuit.

Monolithic resistors typically have tolerances ranging from ±15% to ±25% at room temperature. In addition, the tolerance of monolithic resistors may vary an additional 5% to 25% across reasonable temperatures depending on resistor type and processing. Therefore, when the currents IPTAT and IBIAS are generated based on the resistance values of monolithic resistors, these currents may vary 35% or more.

In order to more accurately produce the currents IPTAT and IBIAS, accurate external or off-chip resistors have been used in place of the monolithic or on-chip resistors. The external resistors may have tolerances as low as 1%, thereby greatly increasing the accuracy of the currents IPTAT and IBIAS from 35% or more down to the accuracy of the on-chip voltage. Typically, multiple off-chip resistors are required to generate the currents IPTAT and IBIAS. However, the external resistors require additional pins to be added to the semiconductor die and increase the number of components, thereby increasing the cost of manufacturing the associated integrated circuit.

Therefore, there remains a need for a circuit and method for generating multiple monolithic electrical currents all referenced to a single external resistor.

SUMMARY OF THE INVENTION

The multiplication circuitry of the present invention operates to generate multiple monolithic electrical currents, all referenced to a single external resistor. A first current referenced to a first monolithic resistor, a second current referenced to a second monolithic resistor, and a third current referenced to an external resistor are used to generate an output current, which is also referenced to the external resistor. The present invention accurately generates two currents each being referenced to the single external resistor, while simultaneously minimizing the number of external connections and overall cost of producing the circuitry.

In an exemplary embodiment, a first current proportional to absolute temperature ($IPTAT_{INT}$) referenced to the first monolithic resistor, a first current independent of temperature ($IBIAS_{INT}$) referenced to the second monolithic resistor, and a second current independent of temperature ($IBIAS_{EXT}$) referenced to the external resistor are used to generate the output current. The output current is a second current proportional to absolute temperature ($IPTAT_{EXT}$), which is also referenced to the external resistor.

In one implementation of the exemplary embodiment, the multiplication circuitry of the present invention generates the second current proportional to absolute temperature ($IBIAS_{EXT}$) by multiplying the first current proportional to absolute temperature ($IBIAS_{INT}$) by a ratio of the second current independent of temperature ($IBIAS_{EXT}$) to the first current independent of temperature ($IBIAS_{INT}$). The multiplication circuitry may be biased by feedback circuitry such that the multiplication circuitry is held out of saturation. Further, the feedback circuitry may be configured to reduce the gain associated with the multiplication circuitry.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
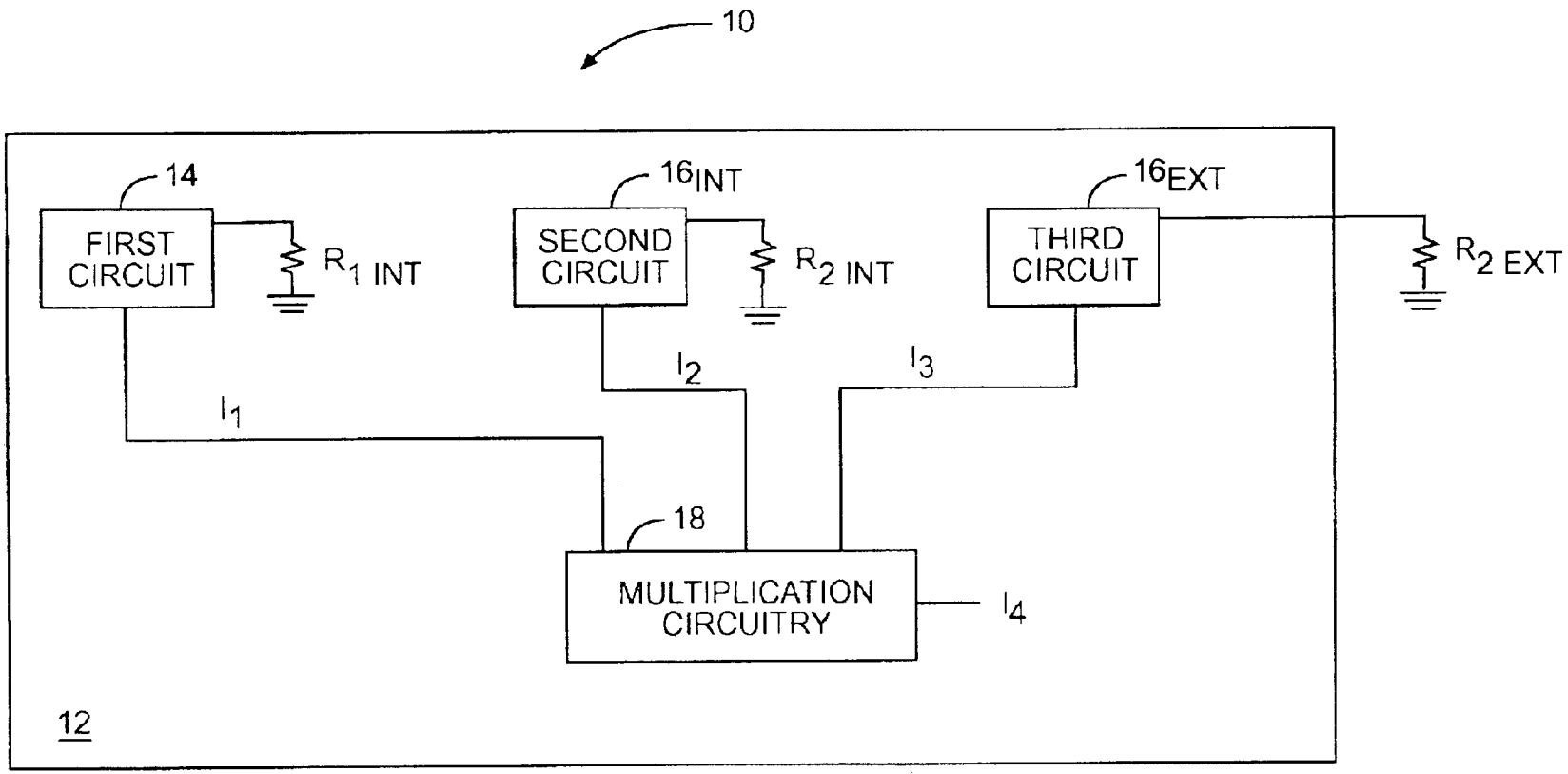
FIG. 1 illustrates a general block diagram of a system for generating multiple currents from one reference resistor according to one embodiment of the present invention.

FIG. 1 illustrates a basic block diagram of a system 10 for generating multiple currents referenced to a single accurate resistor according to the present invention. A single semiconductor die 12 includes a first circuit 14, a second circuit $\mathbf{16}_{INT}$, and a third circuit $\mathbf{16}_{EXT}$, internal resistors $R_{1INT}$ and $R_{2INT}$, and multiplication circuitry 18. In addition to the semiconductor die 12, the system 10 includes an external resistor $R_{2EXT}$. The first circuit 14 generates a first current ($I_1$) based on the first internal resistor $R_{1INT}$, the second circuit $\mathbf{16}_{INT}$ generates a second current ($I_2$) based on the second internal resistor $R_{2INT}$, and the third circuit $\mathbf{16}_{EXT}$ generates a third current ($I_2$) based on the external resistor $R_{2EXT}$. The first current $I_1$ is a first type of current, such as a current proportional to absolute temperature or a current inversely proportional to absolute temperature. The second current $I_2$ and the third current $I_3$ are a second type of current, such as a current independent of temperature. In general, the multiplication circuitry 18 produces a fourth current ($I_4$) that is referenced to the external resistor $R_{2EXT}$ based on the currents $I_1$, $I_2$, and $I_3$, where the fourth current $I_4$ is the same type of current as the first current $I_1$. Therefore, the system 10 produces the third current $I_3$ and the fourth current $I_4$, each referenced to the single accurate external resistor $R_{2EXT}$.

Figure 2:
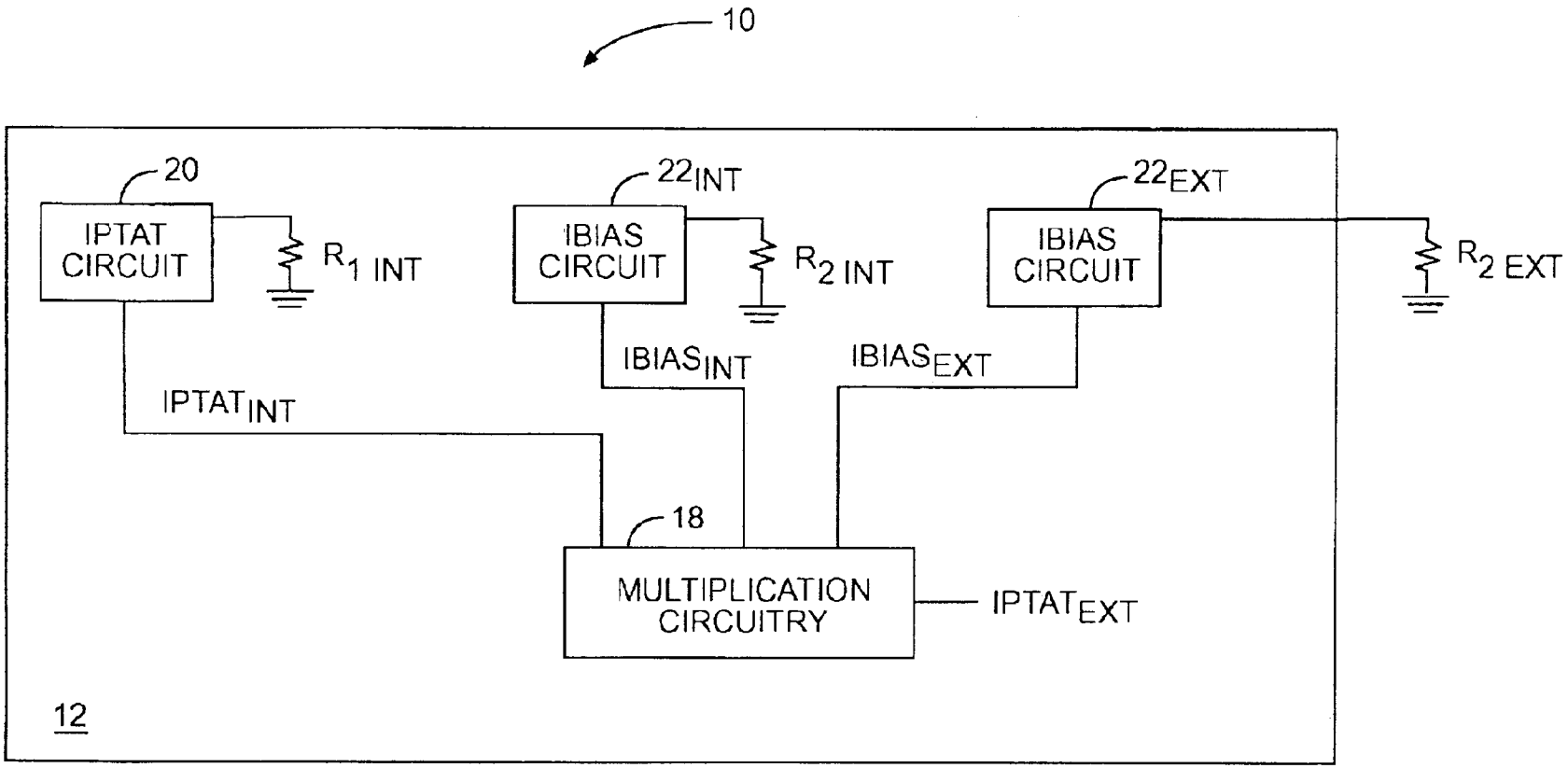
FIG. 2 illustrates an exemplary embodiment of the system illustrated in FIG. 1.
Figure 3:
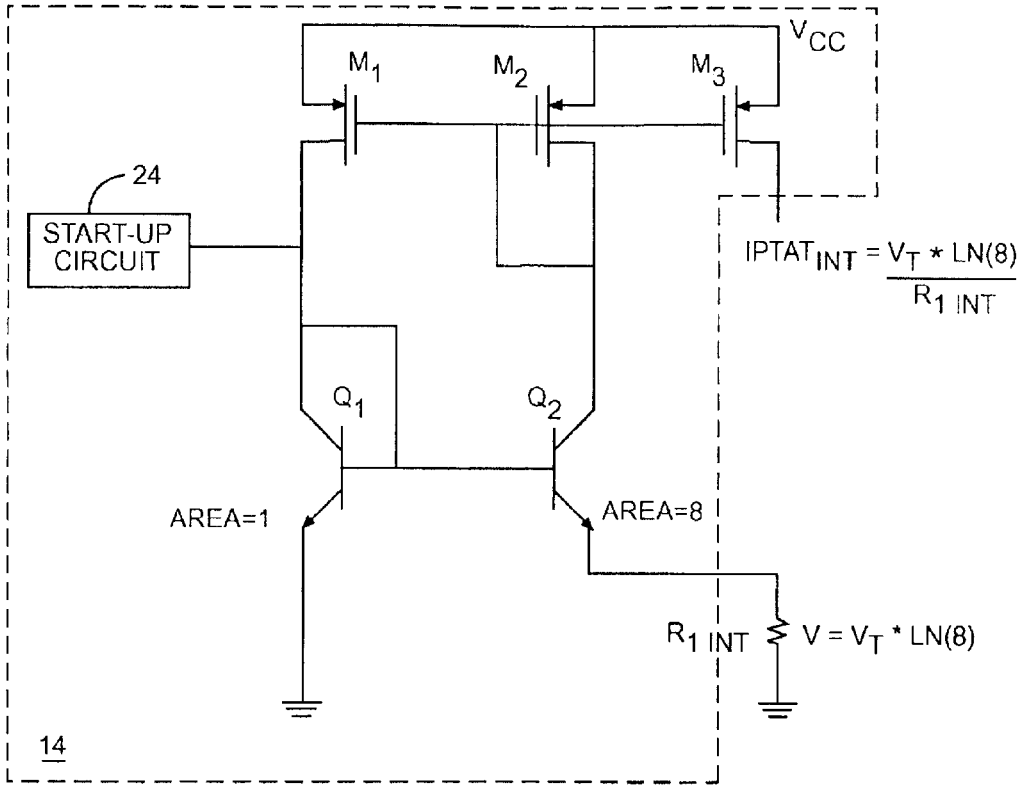
FIG. 3 illustrates a circuit for generating a current proportional to absolute temperature according to one embodiment of the present invention.

FIGS. 2–6 illustrate an exemplary embodiment of the system 10. In this embodiment, the semiconductor die 12 includes an IPTAT circuit 20, a first IBIAS circuit $\mathbf{22}_{INT}$, and a second IBIAS circuit $\mathbf{22}_{EXT}$, the internal resistors $R_{1INT}$ and $R_{2INT}$, and the multiplication circuitry 18. In addition to the semiconductor die 12, the system 10 includes the external resistor $R_{2EXT}$. The IPTAT circuit 20 generates a first current proportional to absolute temperature ($IPTAT_{INT}$) based on the first internal resistor $R_{1INT}$, the first IBIAS circuit $\mathbf{22}_{INT}$ generates a first current independent of temperature ($IBIAS_{INT}$) based on the second internal resistor $R_{2INT}$, and the second IBIAS circuit $\mathbf{22}_{EXT}$ generates a second current independent of temperature ($IBIAS_{EXT}$) based on the external resistor $R_{2EXT}$. In general, the multiplication circuitry 18 produces a second current proportional to absolute temperature ($IPTAT_{EXT}$) that is referenced to the external resistor $R_{2EXT}$ based on the currents $IPTAT_{INT}$, $IBIAS_{INT}$, and $IBIAS_{EXT}$. Therefore, the system 10 produces the currents $IPTAT_{EXT}$ and $IBIAS_{EXT}$ referenced to the single accurate external resistor $R_{2EXT}$ FIG. 3 illustrates the IPTAT circuit 20 in more detail. The IPTAT circuit 20 includes transistors $M_1$, $M_2$, $M_3$, $Q_1$, and $Q_2$, and a start-up circuit 24. As illustrated in FIG. 1, the IPTAT circuit 20 is coupled to an internal resistor $R_{1INT}$. To begin conducting current through the transistors $M_1$, $M_2$, $M_3$, $Q_1$, and $Q_2$, the start-up circuit 24 briefly operates to create a small current through transistors $M_1$ and $Q_1$. This current is mirrored through transistors $M_2$ and $Q_2$. In this example, transistor $Q_2$ has an emitter size (AREA=8) that is eight times larger than the emitter size of transistor $Q_1$ (AREA=1). Therefore, a voltage V is created across resistor $R_{1INT}$ that is defined as:

$$V=V_T*\ln \tag{8}$$

where the term ln(8) is the natural log of the ratio of the current density of transistor $Q_2$ to the current density of the transistor $Q_1$ and the current densities are directly proportional to the emitter areas of the transistors $Q_1$ and $Q_2$. Further, $V_T$ is the thermal voltage defined by the equation:

$$V_T=kT/q,$$

where k is Boltzman's Constant, T is absolute temperature, and q is the charge of an electron. From this equation, it is seen that the voltage $V_T$ and, therefore, the voltage V are proportional to the absolute temperature T.

Once the voltage V is created across resistor $R_{1INT}$, the current through transistors $M_2$ and $Q_2$ is mirrored through transistor $M_3$ and defined by the equation:

$$IPTAT_{INT}=\frac{V_T*\ln(8)}{R_{1INT}}.$$

Hence, the IPTAT circuit 20 produces the current $IPTAT_{INT}$, which is proportional to the voltage $V_T$ and, therefore, to the absolute temperature T. Notably, the current $IPTAT_{INT}$ is also inversely proportional to the resistance of the resistor $R_{1INT}$.

Figure 4:
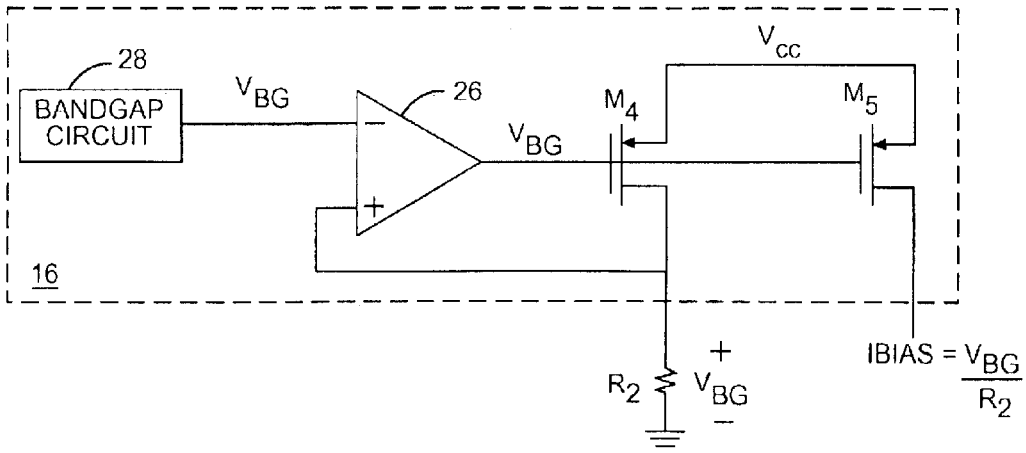
FIG. 4 illustrates a circuit for generating a current independent of temperature according to one embodiment of the present invention.

FIG. 4 illustrates in more detail the IBIAS circuits $\mathbf{22}_{INT}$ and $\mathbf{22}_{EXT}$ for generating the currents independent of temperature $IBIAS_{INT}$ and $IBIAS_{EXT}$. It is important to note that FIG. 4 is a general illustration of both the IBIAS circuits $\mathbf{22}_{INT\ and\ 22}EXT$, wherein resistor $R_{2INT}$ is internal to the semiconductor die 12 and resistor $R_{2EXT}$ is external to the semiconductor die 12 as illustrated in FIG. 2. The IBIAS circuit 22 includes an operational amplifier 26 having an inverting input (−) operatively connected to a bandgap circuit 28. The bandgap circuit 28 provides a stable bandgap voltage $V_{BG}$, which is independent of temperature. The operational amplifier 26 operates to control the voltage at a non-inverting input (+) such that the voltages at both the inverting (−) and non-inverting (+) inputs are equal. Therefore, the IBIAS circuit 22 generates the bandgap voltage $V_{BG}$ across a resistor $R_2$, thereby producing a current defined as $V_{BG}/R_2$ through the resistor $R_2$ and a transistor $M_4$. The IBIAS circuit 22 mirrors the current defined as $V_{BG}/R_2$ through a transistor $M_5$ in order to provide the current IBIAS; and since the bandgap voltage $V_{BG}$ is independent of temperature, the current IBIAS is also independent of temperature.

Figure 5:
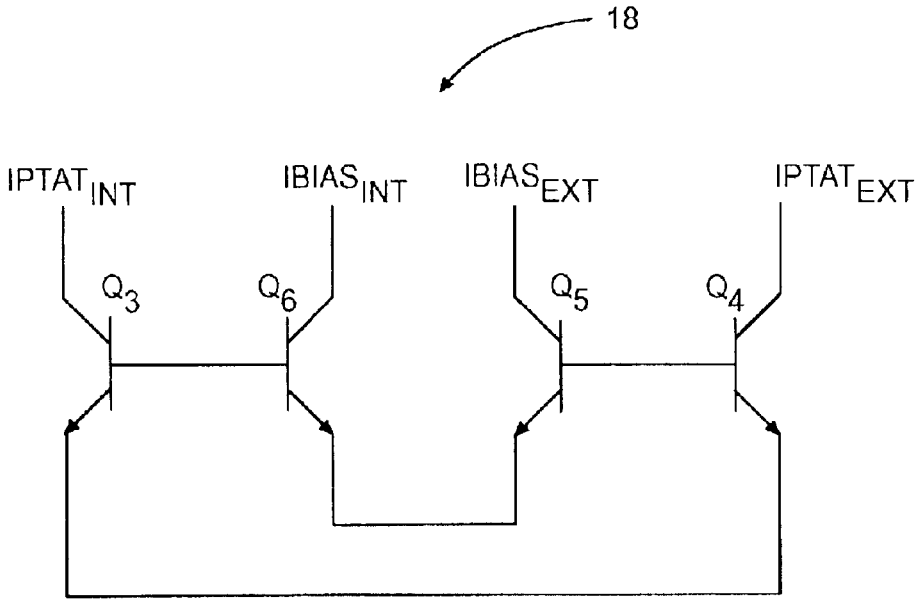
FIG. 5 illustrates a current multiplication circuit according to one embodiment of the present invention.

FIG. 5 illustrates one embodiment of the multiplication circuitry 18, which includes transistors $Q_3$, $Q_4$, $Q_5$, and $Q_6$ interconnected as shown. Although this description of the multiplication circuitry 18 is given with respect to the currents $IPTAT_{INT}$, $IBIAS_{INT}$, $IBIAS_{EXT}$, and $IPTAT_{EXT}$, it is to be recognized that this description also applies to the currents $I_1$, $I_2$, $I_3$, and $I_4$ illustrated in FIG. 1. Current $IPTAT_{INT}$ is a current proportional to absolute temperature generated by a circuit such as the IPTAT circuit 20, where the current $IPTAT_{INT}$ is referenced to an internal resistor. Current $IBIAS_{INT}$ is a current independent of temperature generated by a circuit such as the first IBIAS circuit $\mathbf{22}_{INT}$ where the current $IBIAS_{INT}$ is referenced to an internal resistor, and current $IBIAS_{EXT}$ is a current independent of temperature generated by a circuit such as the second IBIAS circuit $\mathbf{22}_{EXT}$ where the current $IBIAS_{EXT}$ is referenced to an external resistor.

The operation of the multiplication circuitry 18 can best be described mathematically by the following loop equation:

$$V_{BE3}-V_{BE6}+V_{BE5}-V_{BE4}=0,$$

where $V_{BE3}$ is a voltage measured across the base to emitter of the transistor $Q_3$, $V_{BE4}$ is a voltage measured across the base to emitter of the transistor $Q_4$, $V_{BE5}$ is a voltage measured across the base to emitter of the transistor $Q_5$, and $V_{BE6}$ is a voltage measured across the base to emitter of the transistor $Q_6$.

By replacing the base emitter voltages with the forward biased diode current equation, the above loop equation becomes:

$$V_T*\ln\left(\frac{IPTAT_{INT}}{I_S}\right)-V_T*\ln\left(\frac{IBIAS_{INT}}{I_S}\right)+$$

-continued $$V_T * \ln\left(\frac{IBIAS_{EXT}}{I_S}\right) - V_T * \ln\left(\frac{IPTAT_{EXT}}{I_S}\right) = 0.$$

After simplification, the loop equation becomes:

$$\ln\left(\frac{(IPTAT_{INT} * IBIAS_{EXT})}{(IPTAT_{EXT} * IBIAS_{INT})}\right) = 0,$$

which further simplifies to:

$$IPTAT_{EXT} = IPTAT_{INT} * \frac{IBIAS_{EXT}}{IBIAS_{INT}}.$$

In operation, the multiplication circuitry 18 produces the current $IPTAT_{EXT}$, defined as a current proportional to absolute temperature generated based on an external resistor. More importantly, the multiplication circuitry 18 generates the currents $IPTAT_{EXT}$ and $IBIAS_{EXT}$ referenced to only one external resistor, thereby accurately producing these currents using a minimal number of external connections and minimizing the cost of manufacturing the circuit.

Figure 6:
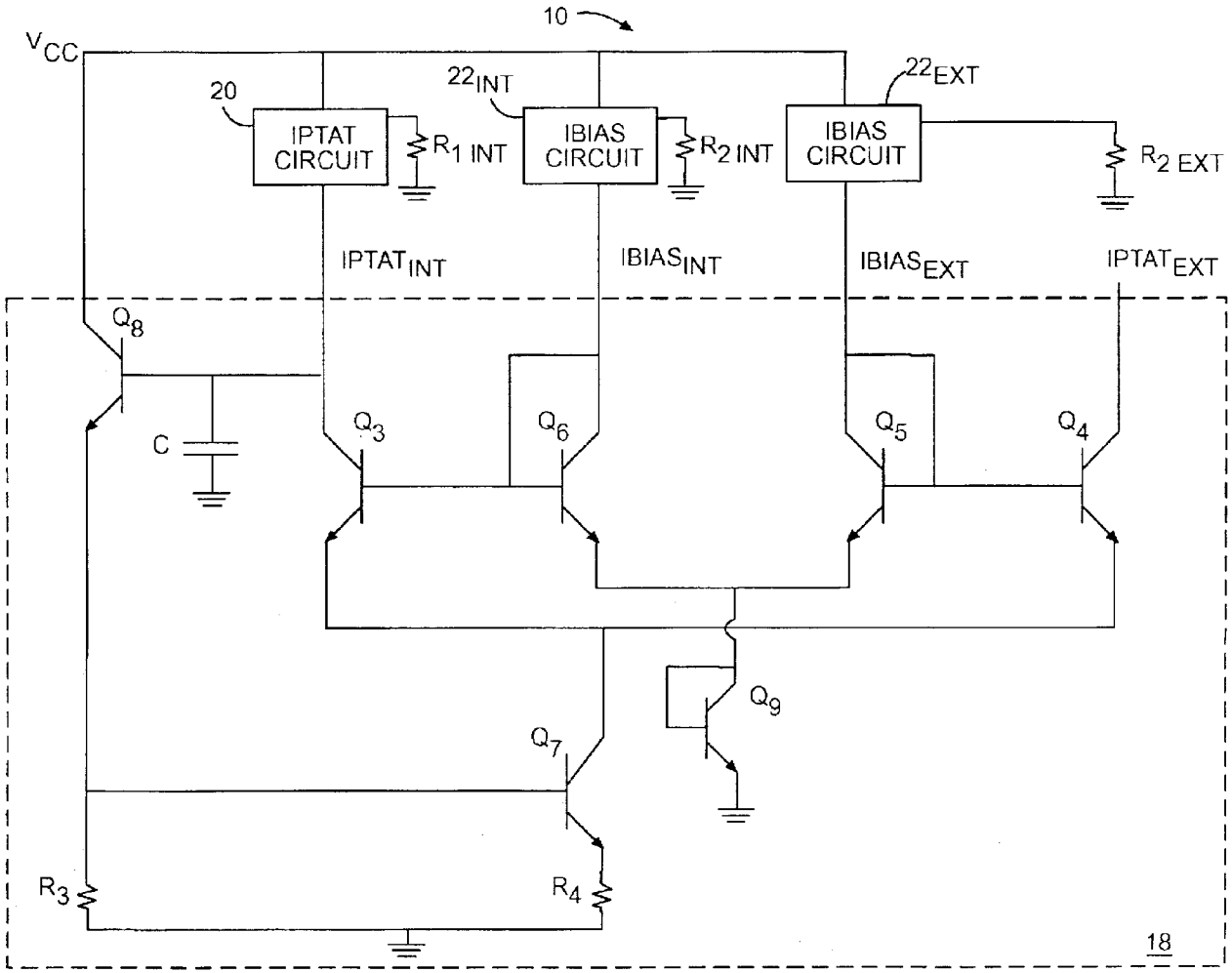
FIG. 6 illustrates one implementation of a current multiplication circuit according to one embodiment of the present invention.

FIG. 6 illustrates a practical implementation of the multiplication circuitry 18, wherein additional circuitry is used to bias the transistors $Q_3$, $Q_4$, $Q_5$, and $Q_6$. In this implementation, biasing of transistors $Q_5$ and $Q_{06}$ is accomplished by diode connecting each of the transistors $Q_5$ and $Q_6$. In order to diode connect each of the transistors $Q_5$ and $Q_6$, the base of transistor $Q_5$ is connected to the collector of transistor $Q_5$, and the base of transistor $Q_6$ is connected to the collector of transistor 06.

Transistors $Q_7$, $Q_8$, and $Q_9$, resistors $R_3$ and $R_4$, and capacitor C form a feedback loop used to bias transistor $Q_3$. The feedback loop operates to control the base of transistor $Q_7$ in order to hold transistor $Q_3$ out of saturation. Transistor $Q_8$ acts on the base of transistor $Q_7$ as an emitter follower and level shifter. Resistor $R_3$ biases transistor $Q_8$, and resistor $R_4$ reduces the loop gain to improve stability. Very little loop gain is necessary, since the absolute voltage at the collector of transistor $Q_3$ is not critical. Therefore, resistor $R_4$ may be biased such that the voltage across resistor $R_4$ is in the range of 50 millivolts to 100 millivolts. Transistor $Q_9$ acts as a level shifter to keep transistor $Q_7$ out of saturation, and capacitor C is a compensation capacitor used to stabilize the feedback loop.

In operation, the IPTAT circuit 20, the first IBIAS circuit $\mathbf{22}_{INT}$, and the second IBIAS circuit $\mathbf{22}_{EXT}$ generate the currents $IPTAT_{EXT}$, $IBIAS_{INT}$, and $IBIAS_{EXT}$ based on resistors $R_{1INT}$, $R_{2INT}$, and $R_{2EXT}$, respectively. The multiplication circuitry 18 operates as described above with respect to FIG. 5, and generates the current $IPTAT_{EXT}$ referenced to external resistor $R_{2EXT}$ based on the currents $IPTAT_{EXT}$, $IBIAS_{INT}$, and $IBIAS_{EXT}$. When implementing the present invention in an integrated circuit, the current $IPTAT_{EXT}$ may be fed to a current mirror circuit in order to provide the current to the entire integrated circuit. The details of current mirror circuits will vary and are commonly known in the art.

Using the present invention, the current $IPTAT_{EXT}$ varies less than 1% due to the ±25% tolerances of the remaining monolithic resistors, and less than 2% as temperature varies from −40° C. to +85° C. Further, the current $IPTAT_{EXT}$ varies less than 4% when $V_{cc}$ is swept from 2.7 volts to 3.6 volts and varies less than 2% when the collector of the transistor $Q_4$ is properly cascoded to match the collector voltages of the transistors $Q_3$, $Q_5$, and $Q_6$. The variation of $IPTAT_{EXT}$ may be further reduced by increasing the channel lengths of transistors $M_1$, $M_2$, $M_3$, $M_4$, and $M_5$. Once these steps have been taken to decrease the variation in the current $IPTAT_{EXT}$, the most significant source of variation remaining is the variation in the bandgap voltage $V_{BG}$ produced by the bandgap circuit 28.

The IPTAT circuit 20, the IBIAS circuit 22, and the implementation of the current multiplication circuit 18 offer substantial opportunity for variation without departing from the spirit and scope of the invention. For example, there are numerous circuits that could be used to produce a current proportional to absolute temperature and a current independent of temperature. The importance of the IPTAT circuit 20 and the IBIAS circuit 22 is to illustrate that resistors $R_1$ and $R_2$ are used as references to produce the currents IPTAT and IBIAS. Further, the implementation of the current multiplication circuit 18 illustrated in FIG. 6 is only one example of a circuit which biases transistors $Q_3$, $Q_4$, $Q_5$, and $Q_6$, such that the current multiplication circuit 18 operates properly. As another example, transistors $Q_7$ and $Q_8$ are illustrated as bipolar junction transistors. However, transistor $Q_7$ may be replaced by an n-type field effect transistor so that resistor $R_4$, which is used for degeneration, is not necessary. Further, transistor $Q_8$ may be replaced by an n-type field effect transistor so that its base current does not interfere with the operation of the multiplication circuit 18.

The foregoing details should, in all respects, be considered as exemplary rather than as limiting. The present invention allows significant flexibility in terms of implementation and operation. Examples of such variation are discussed in some detail above; however, such examples should not be construed as limiting the range of variations falling within the scope of the present invention. The scope of the present invention is limited only by the claims appended hereto, and all embodiments falling within the meaning and equivalency of those claims are embraced herein.

What is claimed is:

1. A semiconductor circuit capable of generating multiple monolithic electrical currents based on a single external resistor comprising:

a) first and second internal resistors;

b) first circuitry adapted to provide a first current referenced to the first internal resistor;

c) second circuitry adapted to provide a second current referenced to the second internal resistor;

d) third circuitry adapted to provide a third current referenced to an external resistor; and e) multiplication circuitry adapted to provide a fourth current referenced to the external resistor and based on the first, second, and third currents.

2. The semiconductor circuit of claim 1, wherein the multiplication circuitry is further adapted to multiply the first current and a ratio of the third current to the second current, thereby providing the fourth current.

3. The semiconductor circuit of claim 1, wherein the multiplication circuitry comprises:

a) a first transistor adapted to receive the first current;

b) a second transistor adapted to receive the second current;

c) a third transistor adapted to receive the third current; and d) a fourth transistor adapted to provide the fourth current, wherein the first, second, third, and fourth transistors operate to multiply the first current and a ratio of the third current to the second current, thereby producing the fourth current.

4. The semiconductor circuit of claim 1, further comprising feedback circuitry adapted to bias the multiplication circuitry such that the multiplication circuitry is held out of saturation.

5. The semiconductor circuit of claim 4, wherein the feedback circuitry is further adapted to reduce a gain associated with the multiplication circuitry, thereby improving stability.

6. The semiconductor circuit of claim 1, wherein the first circuitry comprises first current generation circuitry adapted to provide the first current.

7. The semiconductor circuit of claim 6, wherein the first current is a first current proportional to absolute temperature.

8. The semiconductor circuit of claim 7, wherein the first current generation circuitry comprises:

a) a transistor network adapted to produce a thermal voltage across the first internal resistor, thereby producing a reference current; and b) a mirror circuit adapted to mirror the reference current, thereby providing the first current proportional to absolute temperature.

9. The semiconductor circuit of claim 7, wherein the second circuitry comprises second current generation circuitry adapted to provide the second current.

10. The semiconductor circuit of claim 9, wherein the second current is a first current independent of temperature.

11. The semiconductor circuit of claim 10, wherein the second current generation circuitry comprises:

a) voltage generation circuitry adapted to provide a stable bandgap voltage across the second internal resistor, thereby producing a reference current; and b) a mirror circuit adapted to mirror the reference current, thereby providing the first current independent of temperature.

12. The semiconductor circuit of claim 10, wherein the third circuitry comprises third current generation circuitry adapted to provide the third current.

13. The semiconductor circuit of claim 12, wherein the third current is a second current independent of temperature.

14. The semiconductor circuit of claim 13, wherein the third current generation circuitry comprises:

a) voltage generation circuitry adapted to provide a stable bandgap voltage across the external resistor, thereby producing a reference current; and b) a mirror circuit adapted to mirror the reference current, thereby providing the second current independent of temperature.

15. The semiconductor circuit of claim 13, wherein the fourth current is a second current proportional to absolute temperature.

16. A method for generating multiple monolithic electrical currents based on a single external resistor comprising:

a) generating a first current referenced to a first internal resistor;

b) generating a second current referenced to a second internal resistor;

c) generating a third current referenced to an external resistor; and d) generating a fourth current referenced to the external resistor and based on the first, second, and third currents.

17. The method of claim 16, wherein the generating the fourth current is further based on multiplying the first current and a ratio of the third current to the second current.

18. The method of claim 16, wherein the first current is a first current proportional to absolute temperature.

19. The method of claim 18, wherein the generating the first current proportional to absolute temperature step comprises:

a) producing a thermal voltage across the first internal resistor, thereby producing a reference current; and b) mirroring the reference current, thereby providing the first current proportional to absolute temperature.

20. The method of claim 18, wherein the second current is a first current independent of temperature.

21. The method of claim 20, wherein the generating the first current independent of temperature step comprises:

a) producing a stable bandgap voltage across the second internal resistor, thereby producing a reference current; and b) mirroring the reference current, thereby providing the first current independent of temperature.

22. The method of claim 20, wherein the third current is a second current independent of temperature.

23. The method of claim 22, wherein the generating the second current independent of temperature step comprises:

a) producing a stable bandgap voltage across the external resistor, thereby producing a reference current; and b) mirroring the reference current, thereby providing the second current independent of temperature.

24. The method of claim 22, wherein the fourth current is a second current proportional to absolute temperature.

25. A system for generating multiple monolithic electrical currents based on a single external resistor comprising:

a) means for providing a first current referenced to a first internal resistor;

b) means for providing a second current referenced to a second internal resistor;

c) means for providing a third current referenced to an external resistor; and d) means for providing a fourth current referenced to the external resistor and based on the first, second, and third currents.

26. The system of claim 25, wherein the means for providing the fourth current is further adapted to multiply the first current and a ratio of the third current to the second current, thereby providing the fourth current.

27. The system of claim 25, wherein the first current is a first current proportional to absolute temperature.

28. The system of claim 27, wherein the means for providing the first current proportional to absolute temperature comprises:

a) means for producing a thermal voltage across the first internal resistor, thereby producing a reference current; and b) means for mirroring the reference current, thereby providing the first current proportional to absolute temperature.

29. The system of claim 27, wherein the second current is a first current independent of temperature.

30. The system of claim 29, wherein the means for providing the first current independent of temperature step comprises:

a) means for producing a stable bandgap voltage across the second internal resistor, thereby producing a reference current; and b) means for mirroring the reference current, thereby providing the first current independent of temperature.

31. The system of claim 29, wherein the third current is a second current independent of temperature.

32. The system of claim 31, wherein the means for providing the second current independent of temperature step comprises:

a) means for producing a stable bandgap voltage across the external resistor, thereby producing a reference current; and b) means for mirroring the reference current, thereby providing the second current independent of temperature.

33. The system of claim 31, wherein the fourth current is a second current proportional to absolute temperature.

* * * * *